United States Patent [19]

Steffee

[11] Patent Number: 4,733,860

[45] Date of Patent: Mar. 29, 1988

[54] UPPER TORSO ENGAGEMENT MEANS AND ROTARY TORSO EXERCISE APPARATUS

[75] Inventor: Clay J. Steffee, Lake Helen, Fla.

[73] Assignee: Nautilus Sports, Lake Helen, Fla.

[21] Appl. No.: 880,881

[22] Filed: Jul. 1, 1986

[51] Int. Cl.[4] ..... A63B 21/00

[52] U.S. Cl. ..... 272/134; 272/118; 272/136

[58] Field of Search ..... 272/93, 117, 118, 123, 272/130, 134, 135, 136, 142, 143; 128/78, 87 R, 87 B, 133, 134

[56] References Cited

U.S. PATENT DOCUMENTS

| | | | |
|---|---|---|---|
| 4,296,924 | 10/1981 | Anzaldua et al. | 272/134 X |
| 4,402,505 | 9/1983 | Young | 272/143 X |
| 4,428,578 | 1/1984 | Kirkpatrick | 272/143 X |
| 4,456,245 | 6/1984 | Baldwin | 272/134 X |
| 4,600,196 | 7/1986 | Jones | 272/136 X |
| 4,606,541 | 8/1986 | Kirkpatrick | 272/143 X |
| 4,653,750 | 3/1987 | McIntyre | 272/143 X |

OTHER PUBLICATIONS

Advertisement in "Recreation, Sports and Leisure" for the Abdominal Exercise Machine, Feb., 1986.

*Primary Examiner*—Richard J. Apley
*Assistant Examiner*—Robert W. Bahr
*Attorney, Agent, or Firm*—Morris Fidelman; Franklin D. Wolffe

[57] ABSTRACT

A rotary torso exercise machine, including an upper torso engagement means comprising a back rest, a right side bar and a left side bar. The user hooks elbows around the side bars and presses his or her back against the back rest thereby immobilizing the shoulder muscles, isolating the torso rotation muscles for the rotation exercising movement allowed by the exercise machine.

The invention also comprises a home style rotary torso machine wherein a base member supports a seat on which the lower torso is immobilized and the upper torso engagement means, with all working parts of the machine being mounted in or on the base.

4 Claims, 10 Drawing Figures

UPPER TORSO ENGAGEMENT MEANS AND ROTARY TORSO EXERCISE APPARATUS

The present invention relates to an upper torso engagement means and also to a home style and size rotary torso exercise apparatus of which the upper torso engagement means forms an important part.

INTRODUCTION

Exercising undertaken by persons training for athletic events of various types or pursuing a course of treatment for the rehabilitation of an illness, injury or the like has, in recent years, come to involve the use of special purpose apparatus or machines. Such apparatus, machines and methods have grown out of various concepts and studies regarding physiology and physiological development and function.

One type of apparatus and method which has been used with significant success is full range exercise such as is possible, for example, through the use of the apparatus of Jones U.S. Pat. No. 3,858,873. "Full range" exercise as used with reference to such an apparatus and method, and as used in the description which follows, is a defined term. The defined term "full range exercise" refers to exercise having positive work; negative work; rotary form movement; prestretching; automatically variable, balanced, direct resistance; resistance in the position of full muscular contraction; and substantially unrestricted speed of movement. The interested reader is referred to available publications for further explioation of these characteristic features of full range exercise.

The general field of such exercise and related apparatus and methods is here referred to as "exercise physiology." The field of exercise physiology is related to sports medicine, being the field of medical study which is particularly directed to athletic sports and the like. The development of the field of exercise physiology has involved, among other things, the continuing development of apparatus and methods to accomplish precise application of exercising programs to specific muscles or muscle groups. One such muscle group is that which is associated with the torso rotation movement used in certain sports activities such as tennis and golf.

BACKGROUND OF THE INVENTION

In part, the subject matter of this invention relates to the rotary torso exercise apparatus described in U.S. Pat. No. 4,456,245, the disclosure of which patent being incorporated by reference herein.

Briefly, the exercise apparatus described by U.S. Pat. No. 4,456,245 comprises a machine, wherein the body of the user is positioned and constrained so that the muscles involved in torso rotation are essentially isolated and may then be exercised without substantial interaction with other muscle sets. The user sits in a fixed chair. The hands grasp an upper torso engagement means. The upper torso engagement means is capable of rotary movement about a vertical (to the floor) axis extending through the user's body in general alignment with the spine. Thus, movement by the exercising user is restricted to rotary movement of the upper torso relative to the lower torso. A resistance means in the exercise apparatus imposes predetermined levels of resistance against the rotational movement of the upper torso engaging means.

The exercise machine of U.S. Pat. No. 4,456,245 which is in widespread use as of the date hereof, has generated considerable information on how users actually exercise on the machine. It has been found that many users involve their shoulder muscles to an undesired extent when carrying out the torso rotation exercise routine on the machine.

A principal objective of the present invention is to provide a novel upper torso engaging means that restricts undesired shoulder and arm muscle involvement.

A further objective of the present invention is to provide a novel rotary torso exercise apparatus.

BRIEF DESCRIPTION OF THE INVENTION

Briefly stated, the upper torso engagement means of the present invention comprises a backrest with left and right side bars secured directly to said backrest or to a common support (for side bars and backrest). The side bars extend forward and upward from the backrest so as to fit comfortably in the crook of the elbows when the center of the user's back is pressed against the backrest.

Thus, the user locks his or her elbows around the side bars, elbows as close together as possible and shoulders back, with the back vertical and centered against the backrest. When so positioned, the user effectively restricts the shoulder against movement and thus, isolates the muscles of the torso.

A second aspect of this invention comprises a freestanding (home size) rotary torso machine which comprises: a base adapted for resting on the floor, a lower torso engaging seat upstanding from and fixedly attached to the base; the upper torso engagement means of the invention; and, a stanchion supporting the upper torso engagement means extending upward from the base from a connection point directly under the seat. The stanchion is connected at the base for rotary movement about an axis line extending longitudinally of the user's body generally coincident to the spine. Inside the base is a resistance means connected to the pivotal stanchion and thereby to the upper torso engagement means, allowing rotational movement by the upper torso engagement means.

The backrest and side bars construction of the upper torso engagement means conveniently locates rotational movement path of their support stanchion to the rear of the user's body, allowing the downward extending stanchion of the freestanding (home size) rotary torso machine. In the exercise machine style exemplified by U.S. Pat. No. 4,456,245, the stanchion which extends upward, traverses a path to the front of the user's body.

DETAILED DESCRIPTION OF THE INVENTION

While the present invention will be described more fully hereinafter with reference to the accompanying drawings, in which a preferred embodiment of the present invention is shown, it is to be understood at the outset of the description which follows, that persons of skill in the appropriate arts may modify the invention herein described, while still achieving the favorable results of this invention. Accordingly, the description which follows is to be understood as being a broad, teaching disclosure directed to persons of skill in the appropriate arts, and not as limiting upon the present invention.

Reference is now made to the accompanying drawings wherein:

FIG. 1 is a perspective view of the exercise machine of U.S. Pat. No. 4,456,245 modified to contain the upper torso engagement means of this invention;

Figure 1:
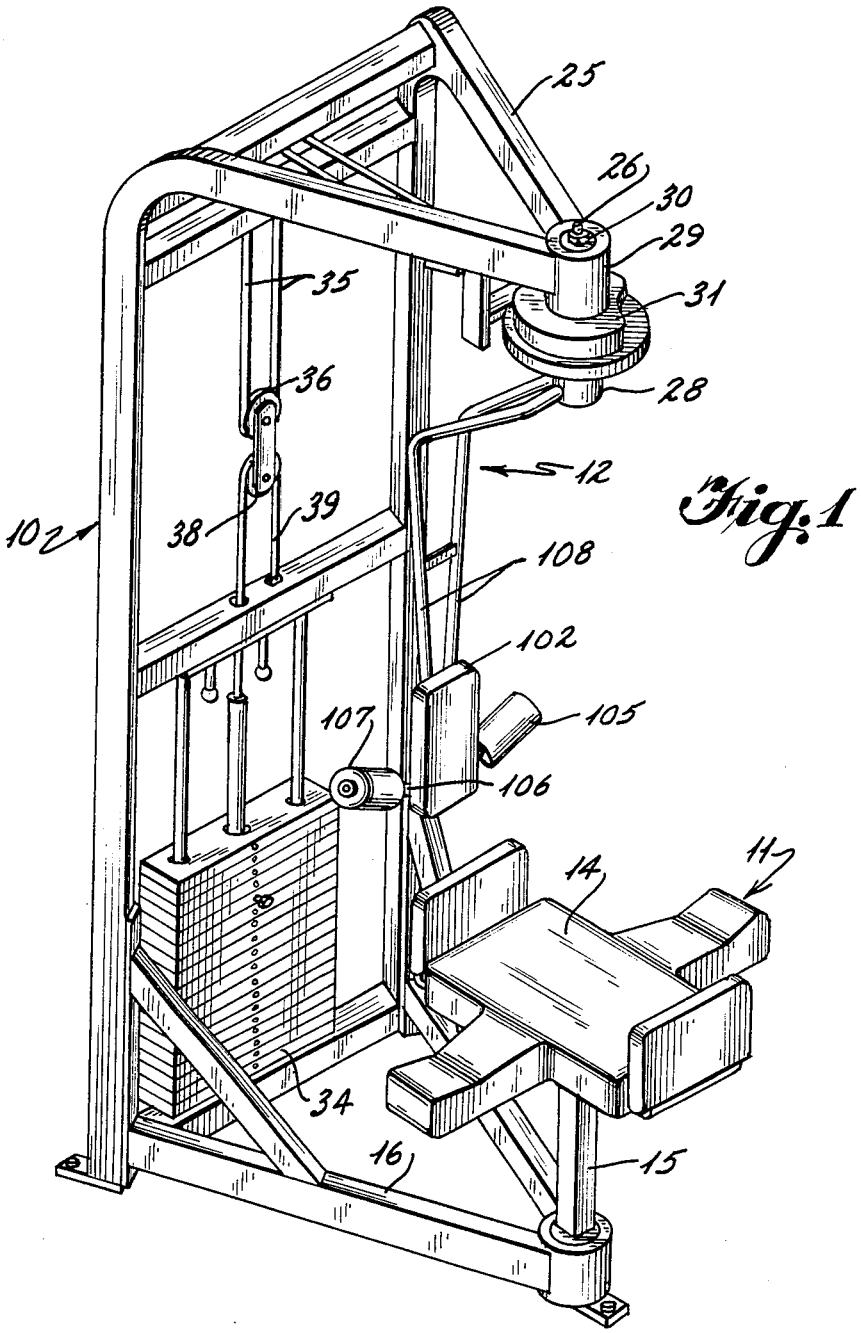

Referring now to FIG. 1, shown there is the rotary torso exercise apparatus of U.S. Pat. No. 4,456,245 modified to contain the upper torso engagement means of the present invention. Except for changes necessitated by the different upper torso engagement means, the apparatus illustrated in FIGS. 1 and 2 corresponds in all details to the exercise machine described in U.S. Pat. No. 4,456,245.

Figure 2:
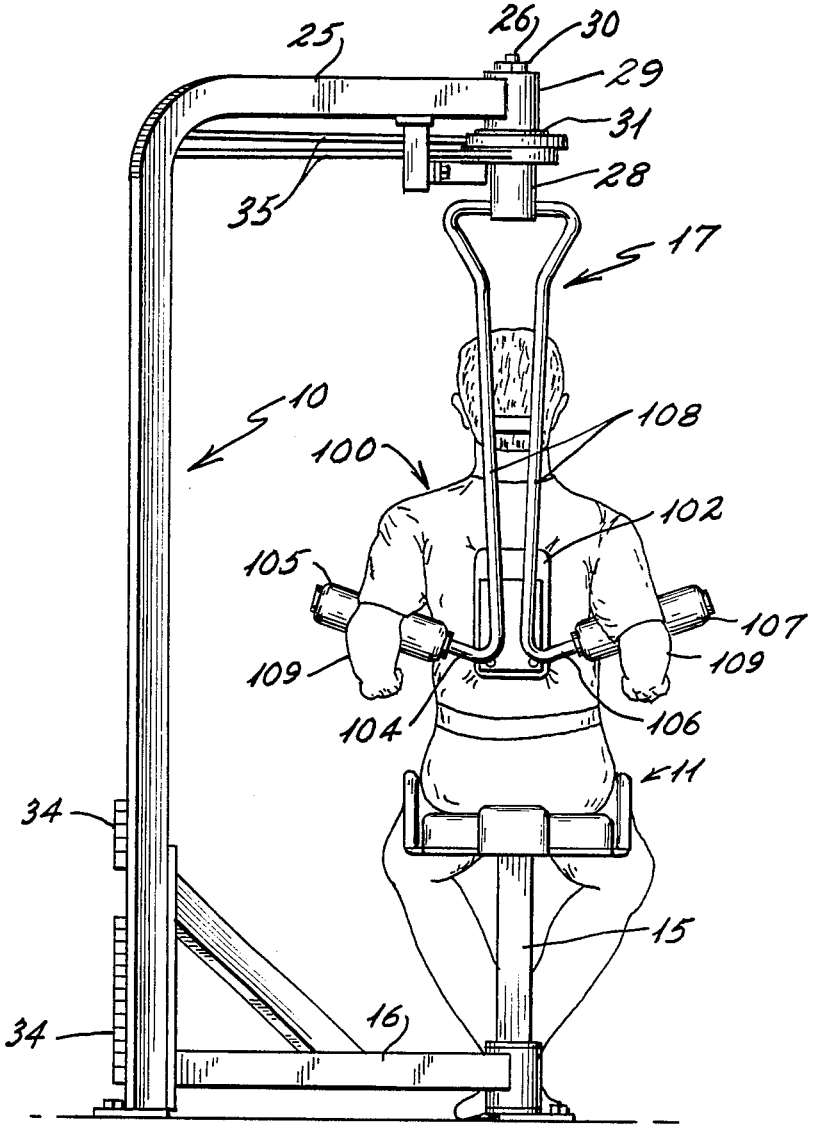
FIG. 2 is a side elevation of the exercise machine illustrated in FIG. 1.

Thus, the apparatus of FIGS. 1 and 2 includes a frame 10 and a base 16, preferably fabricated from steel tubing bar stock, etc. Fixedly mounted on the base 16 is a lower torso engaging means 11 comprising seat 14, mounted on pedestal 15, which in turn is supported by base 16.

Present on frame 10 is an overhead frame portion 25 that extends forward of frame 10 to support a bearing housing 29 located over seat 14. The stub shaft 26 and a mounting member 28 rotate in bearing housing 29, about a vertical axis that coincides with the pedestal 15. Stub shaft 26 and mounting member 28 may be integral, with stub shaft 26 formed as a reduced diameter extension of mounting member 28. The upper torso engaging means 12 which will be described later, is attached to mounting member 28 and may be rotated about an axis which extends vertically through the user's body in general alignment with the spine through an angle of about 90° in either direction from centered position. It may be noted that preloading is desired and to generate preloading the upper torso engaging means 12 is biased about 90° to one side of seat 14 as is illustrated in FIG. 1. A user seated in the normal straight-ahead position, as illustrated by FIG. 2, is under load.

FIGS. 1 and 2 further illustrate an exercise apparatus embodying cam members 31 and 32, which function as a resistance variation means. The cams are linked to weights 34 which impose their gravitational load through chains 35 and 39 on sprockets 36 and 38 in a manner generally known to persons skilled in the exercise apparatus arts. The connection of cam members 31 and 32 to mounting member 28 (not illustrated) is as described in U.S. Pat. No. 4,456,245. Also illustrated in FIGS. 1 and 2 are preferred mode details of the upper torso engagement means 12, the improvement of the present invention.

The upper torso engagement means comprises a backrest 102 suitably in the form of a rectangular pad and left and right side bars 104 and 106 that extend obliquely forward and up from backrest 102. Desirably, the side bars 104 and 106 are surrounded by padded cylinders 105 and 107. The backrest 102 and side bars 104 and 106 are mounted on stanchion 108. In the mode of FIG. 1, the stanchion 108 is a bifurcated member extending from an attachment to the previously described mounting means 28. The side bars 104 and 106 are integral portions of stanchion 108.

Together, the side bars 104 and 106 extend forward from back rest 102 and subtend an angle in the range of about 120°-160° selected for the user's comfort, which angle may, for example, be 150°. For the user's comfort, each side bar is angled up from 10°-40° to horizontal, at 15°, for example.

It may be noted that stanchion 108 is curved so that its connection to mounting 28 will be directly over the user's head, on an axial line parallel to and/or reasonably coincident wih the user's spine.

The objective of the upper torso engagement means of this invention is to restrict the user's shoulders from movement and thus to isolate the muscles of the torso so that only the internal and external obliques are employed to generate rotary movement of the user's torso during exercise on the machine. Exactly how the user's shoulders are restricted by the upper torso engagement means may be understood from description of how the user becomes properly positioned in the exercise machine illustrated herein.

Figure 5:
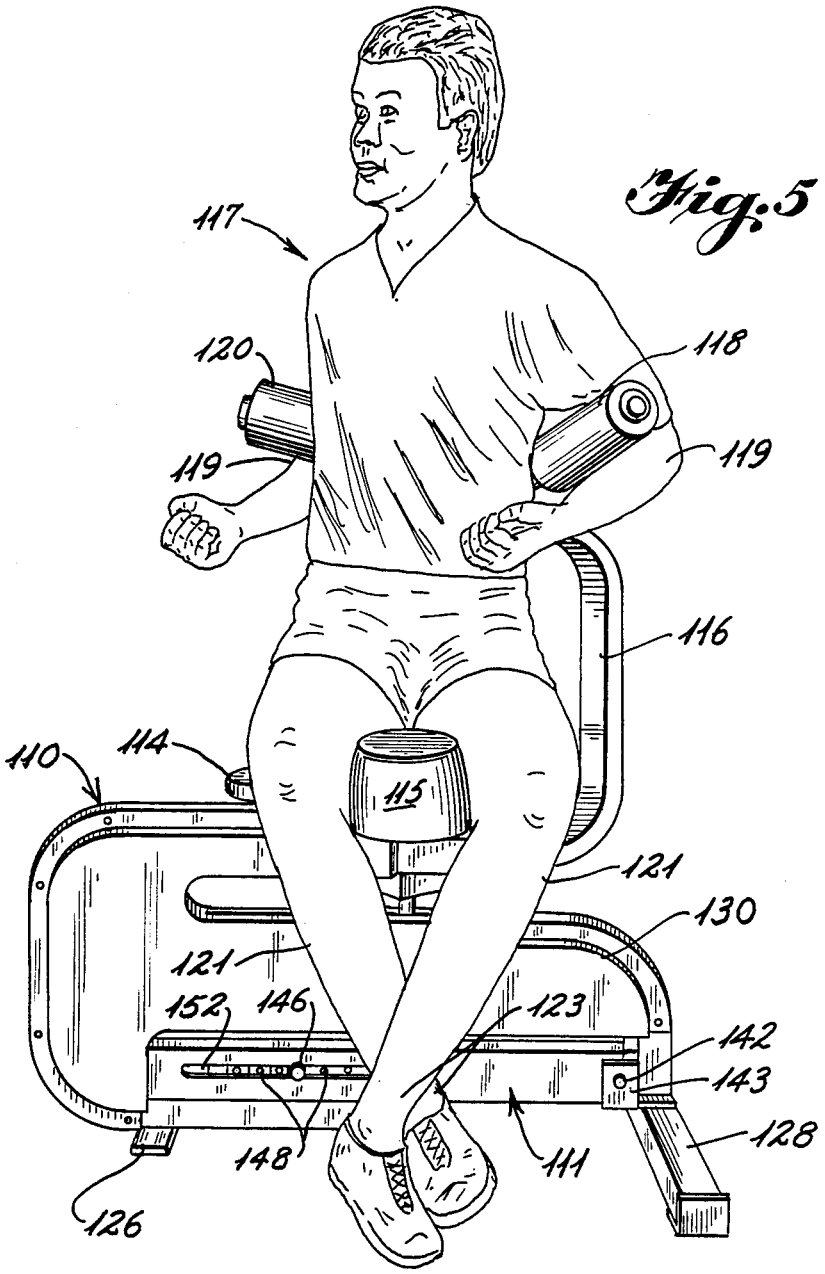
FIG. 5 is a side perspective view of the machine of FIGS. 3 and 4 in exercise use.

The user straddles either horn on the seat 14 crossing the ankles and locking the knees firmly against the horn, keeping the back vertical and as straight as possible. It should be appreciated that upper torso engagement means 12 will be in the preload position which is about 90° to one side of the user. Then with one arm, e.g., the left arm, push the (left) side bar and therewith the entire upper torso engagement means 12 toward center position until the pad of backrest 102 has become centered and is flat against the back. While holding the (left) side bar and backrest in centered position, the other arm, e.g., the right arm, is wrapped securely around the cylindrical pad of the (right) side bar. Holding the upper torso engagement means 12 in centered position with the right arm, frees the left arm so that it, too, may be wrapped around the (other) cylindrical pad. Once both arms are wrapped around the side bars, the user can twist and wiggle the torso and move the upper torso engagement means so that: the backrest 102 is comfortably centered firmly against the user's back; the elbows are as close together as possible, almost behind the back; the back is vertical and as straight as possible; the ankles are crossed; and the knees are locked firmly against the seat, all as is illustrated in FIGS. 2 and 5 of the drawing.

The user position may feel somewhat awkward to many persons, but it effectively restricts shoulder movement and thus succeeds in the intended objective, namely, to isolate the muscles of the torso during exercising movement.

As with the rotary torso exercise machine according to U.S. Pat. No. 4,456,245, a user wishing to develop the torso rotation muscles will select an appropriate number of weights from weight stack 34 to provide the desired level of resistance to motion and will carry out an exercise regimen suited to the particular user. For a full exercise sequence, the user will straddle one horn of seat 14 for exercising with a preload to one side of the torso, then will straddle the other horn for exercising with a preload to the other side of the torso.

It is noted now that shifting the side to side swing of the upper torso engagement means from a passage path in front of the user, as in the apparatus of U.S. Pat. No.

4,456,245, to a passage path behind the user as in the upper torso engagement means 12 of the present invention, offers substantial advantages. As will be explained hereafter, a backside swing for the upper torso engagement means of this invention has made feasible a rotary torso exercise machine construction that is sufficiently compact and lightweight to be suitable for home use as a personal rotary torso exercise machine.

Figure 3:
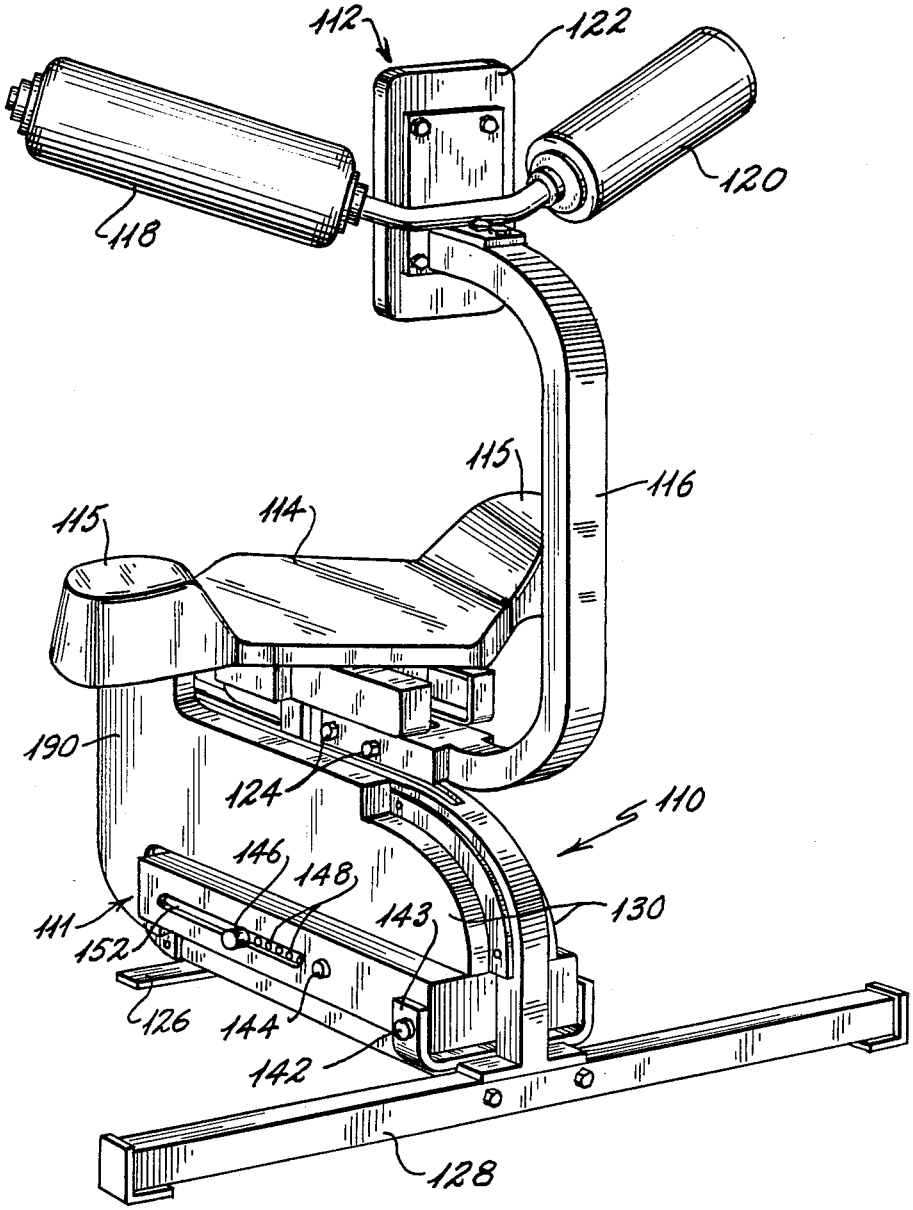
FIG. 3 is a rear perspective view of the freestanding exercise machine of this invention.
Figure 4:
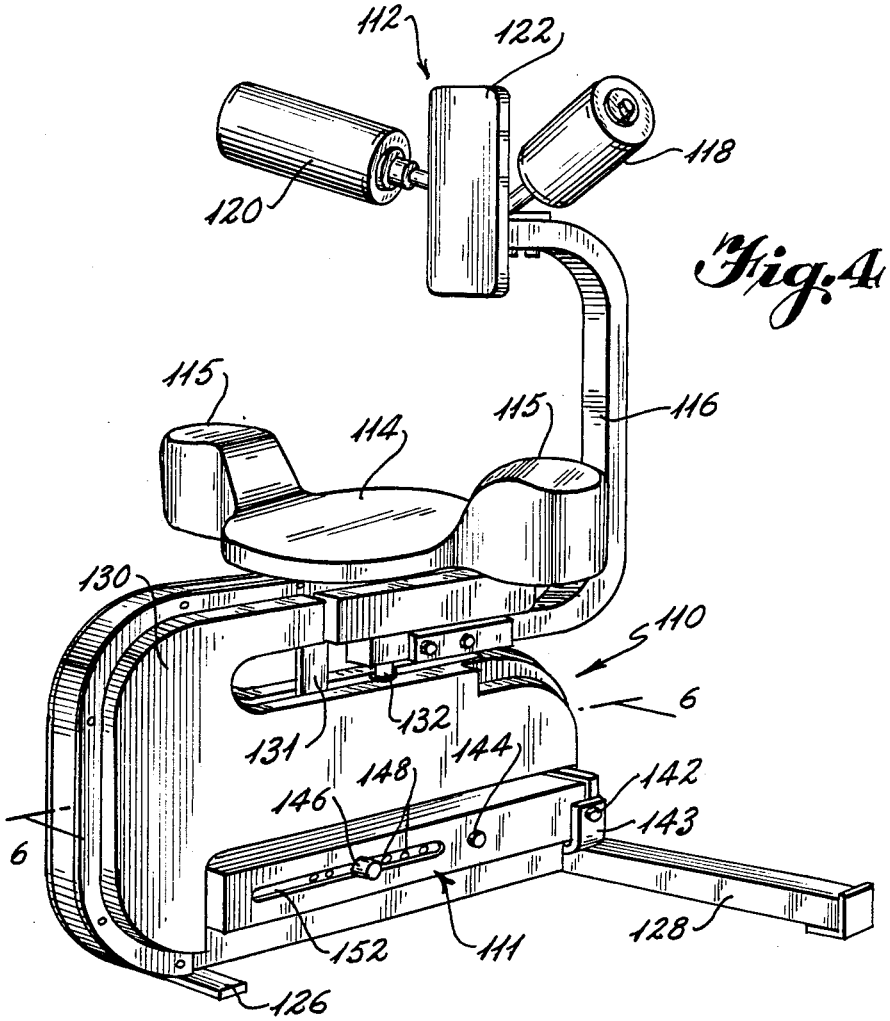
FIG. 4 is a front perspective view of the exercise machine of FIG. 3.

Reference is now made to FIGS. 3 and 4 wherein is illustrated the home style and size rotary torso exercise machine 110 of the present invention. It may be seen thereon that the upper torso engagement means assembly 112 is mounted at the end of a stanchion 116 which extends beneath the user to a pivotal connection link 132 located directly under the seat 114 and on the axis line extending through the center of the seat 114 longitudinally of the user's body coincident to the spine. To provide place for pivotal connection, the base 130 of exercise machine 110 is provided with an elongated slot wherein the stanchion 116 is bolted (by bolts 124) to pivotal connection link 132. Seat 114 is, of course, fixedly mounted on the upper portion of base 130. It has been found desirable to provide reinforcement for the seat by (off-center) bar 131 located under seat 114.

Referring particularly, to FIG. 5, it may be seen that the upper torso engagement means assembly 112 which always is located directly behind the user swings or pivots behind the user (about 180° from one side of the user to the opposite side). At no time does the stanchion 116 support for the upper torso engagement means pass in front of the user seated on exercise machine 110. The user is left space to mount the exercise machine 110 by straddling either horn 115 of seat 114 crossing ankles 123, gripping legs 121 and knees on horn 115 to position himself or herself on the exercise machine as has already been described.

As an aside, it may be noted that the construction details for padded side bars 118 and 120, padded back rest 122 and stanchion 116 in the upper torso engagement assembly 112 differ from those illustrated in FIGS. 1 and 2 for the assembly of upper torso engagement means 12 without changes in the relative position of side bars to back rest and of both to their stanchion support.

Also, the structure of exercise machine 110 allows, should such ever be desired, a reversal of parts wherein seat 114 is joined to pivotal connection link 132 and stanchion 116 is (non-movably) joined to reinforcing bar 131. Preferred is, of course, the illustrated mode.

Figure 9:
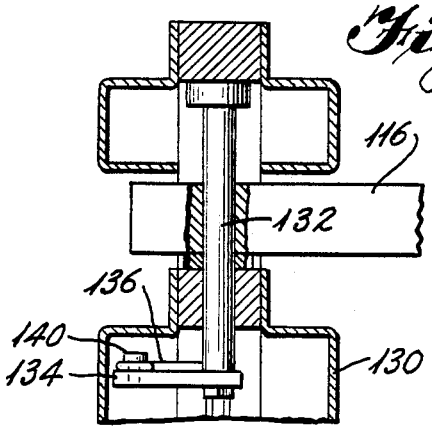
FIG. 9 is a section taken along line 9—9 of FIG. 6.
Figure 6:
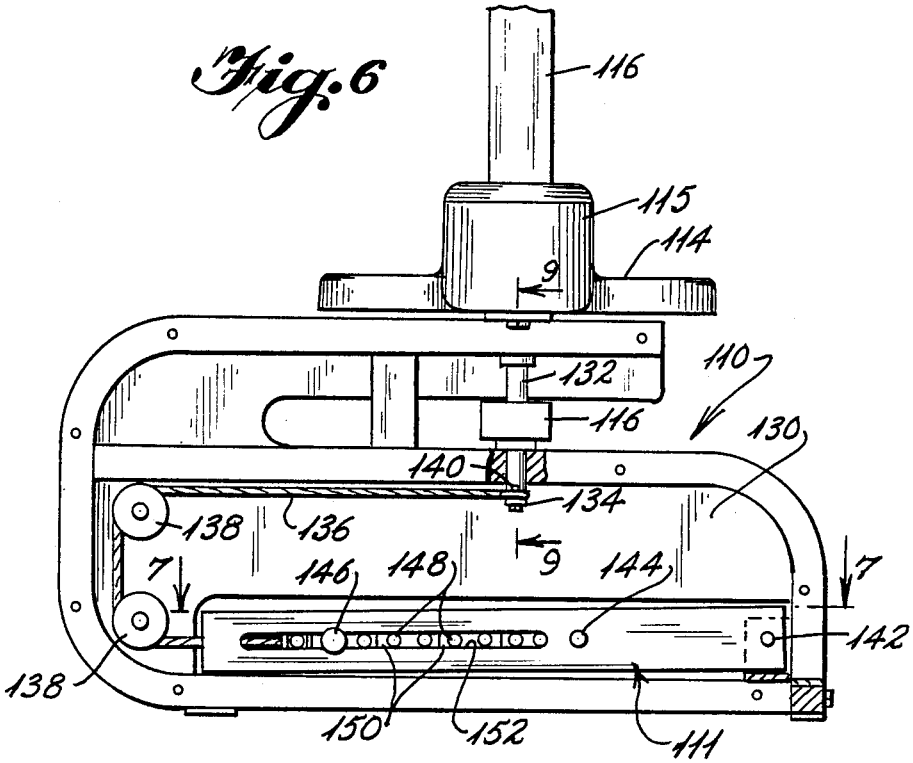
FIG. 6 is a side elevation and section taken along line 6—6 of FIG. 4.

The resistance means for home exercise machine 110 and the connections thereof to stanchion 116 are located inside of the base 130 of home use exercise machine 110. Referring now to FIG. 6 and the partial view of FIG. 9 it may be seen that behind the face shield 190 of base 130, a chain or a cable 136 carried over sprockets 138 extends from resistance assembly housing 111 to a pin 140 on crank arm 134 carried by the pivotal connection link 132. The resistance assembly 152 inside housing 111 biases crank 140 and therewith the stanchion 116 so that the rest position of the resistance assembly biases the upper torso engagement means assembly 112 to about a 90° offset from seat 124, i.e., to the desired preload position of the rotary torso exercise machine 110 illustrated in FIG. 3. Thus, the resistance assembly in housing 111 is a counterpart to the stack of weights 34 in the exercise machine mode of FIG. 1.

The details of the resistance assembly 152 are illustrated in FIGS. 6, 7, 8 and 10, to which reference is now made. The force generating analog of a weight stack comprises a multiplicity of elastic cords 156. Each elastic cord 156 is set inside of a U-shaped (cord) guide channel 150 being constrained therein adjacent the face and sidewalls of channel 150 by attachment means 158 at the cord ends. All the elastic cords 156 loop around a common shaft 142 that extends outside housing 111. The shaft 142 serves also to anchor resistance assembly housing 111 to base 130 at bracket 143. The channels 150 are free individually to move away from shaft 142 when tension applied by chain 136 pulls on one or more channels, causing elastic cord(s) 156 to stretch. The elastic cords 156 should never be completely slack; some tension is needed on each cord to hold its guide channel 150 against shaft 142.

Figure 10:
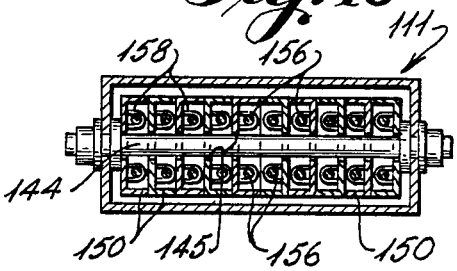
FIG. 10 is a section taken along line 10—10 of FIG. 7.
Figure 7:
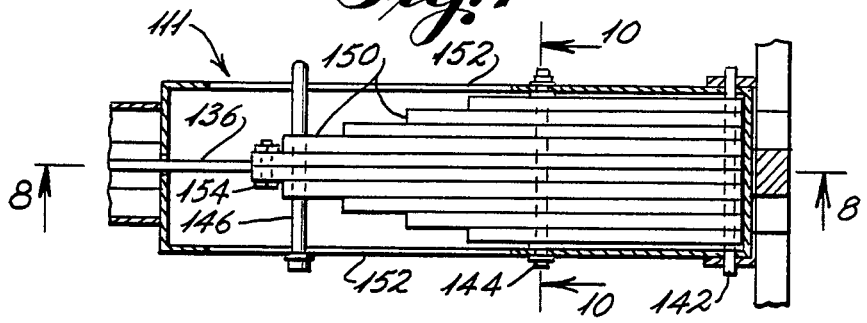
FIG. 7 is a section taken along line 7—7 of FIG. 6.
Figure 8:
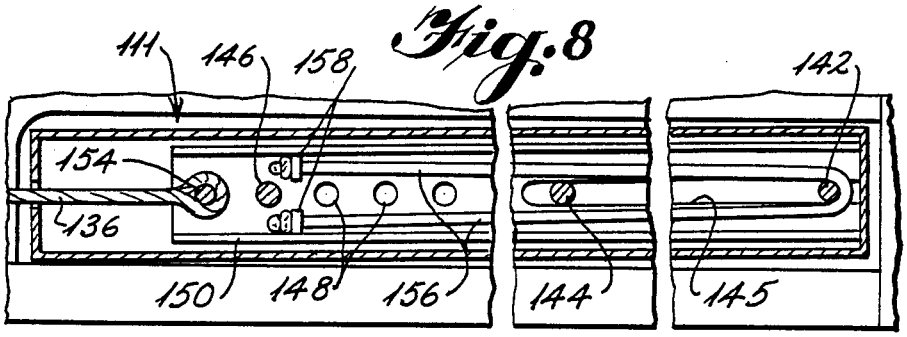
FIG. 8 is a section taken along line 8—8 of FIG. 7.

A multiplicity of elastic cord guide channels 150 e.g., ten, are provided in an array as illustrated in FIG. 10. The individual channels 150 are sized in an asymmetric step fashion, much like an organ, ranging in length from two equal length central channels to a shortest channel at one side of the array as is illustrated in FIG. 7.

The channels 150 are constrained into an array by presence of bolt 144 that extends through all of the channels at an elongated slot 145 in each of the cord guide channels 150. When the centermost channels are moved by chain 136 relative to outer channels (as when outer channels remain retained against shaft 142 by their elastic cords), the bolt 144 rides in the slot 145 of the channels. The elastic cord guide channels 150 may be selectively connected together, and correspondingly, the number of elastic cords so joined provided predetermined levels of resistance to movement by the channels.

Selective connection of channels 150 together is made by a pin and hole arrangement. Each channel face is perforated by a number of holes that depends upon channel length. The shortest channel (an outside channel) has but one hole 148 adjacent the end away from shaft 142. The next shortest channel (the other outside channel) has two holes, one in line with the hole in the shortest channel, the other nearer the channel end away from shaft 142. The third shortest channel has three holes; the fourth shortest channel has four holes, etc. In the channel array herein illustrated, the two matched-in-length centermost channels have nine holes. Their top most holes contain bolt 154 to serve for attachment of chain 136 to the resistance assembly 152, providing then the lowest resistance setting for exercise machine 110 i.e., the resistance required to tension the two elastic cords 156 in the centermost channels 150. By insertion of pin 146 into one of the eight illustrated settings for holes 148, other channels are connected to the centermost channels. The user can pin together from three to all ten hole sets to connect from three to all ten channels of the array, increasing thereby the level of resistance to exercise movement as desired.

Thus, when the user exercises the lower torso muscles in exercise machine 110 and in so doing, pivots the stanchion 116, the pivoting movement is selectively resisted by elastic cords 156 in from as few as two to as many as all ten elastic cord guide channels 150. As may be seen in FIG. 4, the pin 146, which controls the level of resistance, is inserted and/or removed from the outside of base 130 which, of course, is a convenience to the user.

The resistance assembly per se and a chain and sprocket linkage to connect the pivoting stanchion to the resistance system have been employed in exercise machines prior to the date of this invention, but not in the fashion employed for rotary torso exercise machine 110. It should be appreciated that disposing the resistance assembly housing 111 in horizontal attitude parallel to and adjacent the floor (at the bottom of base 130) helps stabilize the exercise machine 110 for generating a low center of gravity.

Also, as should be apparent from the drawing, the elastic cord resistance assembly 152 of the preferred mode herein illustrated constitutes a prefabricated unit disposed in its own housing 111 and housing 111 is mounted horizontally in a recess portion of the base 130. As has already been pointed out, housing 111 is secured to base 130 by U-shaped bracket 143 by attachment of shaft 142 around which all of the elastic cords are looped.

Base 130 and the exercise machine 110, as a whole, sit on front and rear skids 126 and 128. It has been found desirable to provide a wider floor skid 128 adjacent the bracket 143 that secures housing 111 to and in base 130. It may be noted that housing 111 and skids 126 and 128 are clear of the user's feet, which, incidentally, are always at one or the other side face of base 130; see FIG. 5.

The home rotary torso machine of the present invention has been found to be a very satisfactory home exercise unit as well as being both attractive and lightweight.

What is claimed is:

1. In an apparatus for exercising torso rotation muscles said apparatus having means for supporting a user's body in a generally upright seated position and including a rotatable upper torso engagement means and a fixed lower torso engagement means having a seat portion, said user body supporting means allowing rotational movement of said upper torso engagement means relative to said lower torso engagement means about an axis extending longitudinally of a user's body along a line passing through the user's body and adjacent and generally coincident to the spine; and resistance means operatively connected to said upper torso engagement means for imposing force resisting movement of said upper torso engagement means about said axis; said upper torso engagement means having a stanchion pivotal about a support axis and connected at one end to the resistance means, with left and right side bars mounted in fixed relation to one another and on a depending end of said stanchion, the improvement comprising:

means, integral with said upper torso engagement means, for immobilizing shoulder muscles of said user in order to restrict undesired shoulder and arm movement during said torso rotation muscles exercising, said shoulder muscles immobilizing means comprising a backrest means for pressing engagement with said user's back during said torso rotation muscles exercising and side bars extending outwardly from said backrest means, said backrest means being elongated in the direction of the users spine from generally said stanchion depending end and upwardly toward the user's head, and each said side bar being angled upward from said depending end at an angle from horizontal of from 10°–40° and toward said user at a subtended angle of from 120°–160°, said backrest being elongated sufficiently and each of said side bars being angled relative thereto sufficiently to fit comfortably in the crook of each elbow of a user seated in said body supporting means, back pressed against said backrest means, so as to immobilized said shoulder muscles during said exercising.

2. A rotary torso machine comprising a base adapted to rest on the floor; a seat upstanding upward from said base for supporting a user's body in a generally upright seated position; and a stanchion extending upward from said base, said stanchion supporting an upper torso engagement means;

an upper torso engagement means supported by said stanchion which comprises a backrest and left and right side bars in fixed relation to said backrest and to each other, each said side bar extending forward from said backrest at an angle thereto so as to fit comfortably in the crook of the elbow when a user's back is pressed against said backrest;

said seat being fixedly secured to said base, and said stanchion being pivotally connected to said base beneath said seat for rotary movement about an axis line passing through a user's body adjacent and generally coincident to the spine; and resistance means located in said base operatively connected to said stanchion and thereby to said upper torso engagement means for imposing force resisting pivotal movement of said upper torso engagement means, said fixedly secured seat and said upper torso engagement means cooperating for restricting movement of a user's body during exercise to rotary movement about said axis line and for isolating the torso rotation muscles of the user's body and for exercising such muscles against the force imposed by said resistance means.

3. A rotary torso machine according to claim 2 further comprising an array of elastic cords as said resistance means, said array of elastic cords being located in said base parallel to and adjacent to the floor on which said machine is adapted to rest.

4. A rotary torso machine according to claim 3 further comprising a housing wherein said array of elastic cords is mounted and a recess in said base adjacent the bottom thereof wherein said housing is horizontally disposed.

* * * * *